US008881775B2

(12) United States Patent
Turgeman

(10) Patent No.: US 8,881,775 B2
(45) Date of Patent: Nov. 11, 2014

(54) REFILL PERFUME BOTTLE

(75) Inventor: Carmit Turgeman, Askelon (IL)

(73) Assignee: Beauty Union Global Limited, Chai Wan (HK)

( * ) Notice: Subject to any disclaimer, the term of this patent is extended or adjusted under 35 U.S.C. 154(b) by 0 days.

(21) Appl. No.: 13/302,405

(22) Filed: Nov. 22, 2011

(65) Prior Publication Data

US 2012/0090733 A1 Apr. 19, 2012

Related U.S. Application Data

(62) Division of application No. 11/568,026, filed as application No. PCT/IL2005/000402 on Apr. 18, 2005, now Pat. No. 8,079,388.

(30) Foreign Application Priority Data

Apr. 20, 2004 (IL) ..... 161515

(51) Int. Cl.
*B67C 3/02* (2006.01)
*B05B 11/00* (2006.01)
*A45D 34/02* (2006.01)

(52) U.S. Cl.
CPC ..... *B05B 11/0037* (2013.01); *A45D 34/02* (2013.01); *B05B 11/0056* (2013.01); *B05B 11/0035* (2013.01); *B05B 11/30* (2013.01)
USPC ..... 141/113; 141/2; 141/351; 141/352; 215/2

(58) Field of Classification Search
CPC ..... B65D 1/06
USPC ..... 141/3, 20, 113, 346–362, 2; 401/219, 401/220; 215/2
See application file for complete search history.

(56) References Cited

U.S. PATENT DOCUMENTS

| | | | | |
|---|---|---|---|---|
| 2,643,535 | A | 12/1948 | Strumbos | |
| 3,559,701 | A | 2/1971 | Wittersheim et al. | |
| 3,601,164 | A | 8/1971 | Bruce | 141/20 |
| 3,601,165 | A | 8/1971 | Obata | |

(Continued)

FOREIGN PATENT DOCUMENTS

| | | | |
|---|---|---|---|
| CN | 2114634 | U | 9/1992 |
| CN | 201055827 | Y | 5/2008 |

(Continued)

OTHER PUBLICATIONS

Request for Reexamination of U.S. Patent No. 8,079,388, Dated Jul. 24, 2013 (Reexaminatation Control No. 90/012,926.

(Continued)

*Primary Examiner* — Timothy L Maust
(74) *Attorney, Agent, or Firm* — William H. Dippert; Eckert Seamans Cherin & Mellott, LLC

(57) ABSTRACT

The present invention teaches a refill bottle adapted to repeated receive and dispense liquid such as perfume. The refill bottle comprises a bottle having a bottom portion and an upper portion, an opening provided in the upper portion wherein the opening is adapted to be covered, and a refill mechanism provided in the bottom portion. The liquid is received through the refill mechanism from a regular bottle preferably provided with a spraying mechanism and its dispensed through the opening.

8 Claims, 3 Drawing Sheets

(56) References Cited

U.S. PATENT DOCUMENTS

| | | | | | |
|---|---|---|---|---|---|
| 3,718,165 | A | | 2/1973 | Grothoff | 141/20 |
| 4,197,884 | A | | 4/1980 | Maran | 141/383 |
| 4,473,097 | A | | 9/1984 | Knickerbocker et al. | |
| 4,662,412 | A | | 5/1987 | Swallert | |
| 4,712,593 | A | * | 12/1987 | Zulauf et al. | 141/113 |
| 4,877,065 | A | | 10/1989 | Lamboy et al. | 141/18 |
| 4,988,017 | A | | 1/1991 | Schrader et al. | 222/130 |
| 5,524,680 | A | | 6/1996 | de Laforcade | 141/18 |
| 5,623,974 | A | | 4/1997 | Losenno et al. | |
| 5,791,527 | A | | 8/1998 | Giuffredi | 222/321.9 |
| 5,865,350 | A | | 2/1999 | Losenno et al. | |
| 6,435,231 | B1 | | 8/2002 | Cooper et al. | 141/346 |
| 6,533,482 | B1 | | 3/2003 | Byun | |
| 6,607,012 | B2 | | 8/2003 | Yquel | 141/20 |
| 6,857,806 | B2 | | 2/2005 | Harrison et al. | 401/219 |
| 6,883,564 | B2 | | 4/2005 | Risch et al. | 141/113 |
| 7,377,296 | B2 | | 5/2008 | Gueret | 141/352 |
| 7,665,635 | B2 | | 2/2010 | Ramet et al. | 222/321.7 |
| 8,079,388 | B2 | | 12/2011 | Turgeman | |
| 2002/0057938 | A1 | | 5/2002 | Gueret | |
| 2005/0056343 | A1 | | 3/2005 | Gueret | |
| 2005/0284891 | A1 | | 12/2005 | Ramet et al. | |

FOREIGN PATENT DOCUMENTS

| | | | |
|---|---|---|---|
| DE | 1166225 | | 9/1958 |
| DE | 1798193 | | 10/1959 |
| DE | 1802692 | | 12/1959 |
| DE | 1823288 | | 12/1960 |
| DE | 1968728 | | 9/1967 |
| DE | 2540875 | | 9/1975 |
| DE | 8307900 | U1 | 3/1983 |
| EP | 1283180 | A2 | 2/2003 |
| FR | 2073087 | | 9/1971 |
| FR | 2698341 | A1 | 11/1992 |
| FR | 2893598 | A1 | 11/2005 |
| GB | 938331 | | 11/1959 |
| GB | 2095103 | | 9/1982 |
| GB | 2137181 | A | 2/1984 |
| GB | 2229380 | | 9/1990 |
| JP | 5125605 | | 8/1976 |
| JP | 8175578 | A | 7/1996 |
| JP | 2004182305 | A | 7/2004 |
| WO | 0243794 | A1 | 6/2002 |

OTHER PUBLICATIONS

Corrected Request for Reexamination of U.S. Patent No. 8,079,388, Dated Sep. 3, 2013 (Reexamination Control No. 90/012,926.

Decision Regarding Reexamination Control No. 90/012,926, Dated Oct. 29, 2013.

* cited by examiner

REFILL PERFUME BOTTLE

CROSS-REFERENCE TO RELATED APPLICATIONS

This application is a divisional of commonly assigned U.S. patent application Ser. No. 11/568,026, filed Oct. 17, 2006, now U.S. Pat. No. 8,079,388 which, in turn, is a National Phase filing of PCT Patent Application No. PCT/IL2005/000402, filed Apr. 18, 2005, which, in turn, is based upon Israeli Patent Application No. 161515, filed Apr. 20, 2004, each of which is incorporated herein in its entirety.

FIELD OF THE INVENTION

The present invention relates to perfume bottles. More particularly, the present invention relates to a bottle adapted to be refilled, especially for perfumes.

BACKGROUND OF THE INVENTION

Perfumes, aftershave and the like products in bottles are mostly sold in volumes of about 100 cc and much more. Since perfume and other relative liquids are relatively an expensive commodity, and are available in relatively high volume packs, the users don't tend to carry the bottles with them. There are available traveler's bottles, however, those bottles are provided with a conventional narrow opening that is provided with rotatable cover through which the liquid from the large pack has to be spilled. It is already mentioned that the liquids are relatively expensive and the spilling action through a narrow opening can result in losing some of the material. Moreover, most perfume and aftershave bottles are provided with vaporizer mechanism for spraying the liquid onto the body, and those bottles cannot be open and spilled easily.

There is no available bottle that can be refilled with a liquid such as perfume or aftershave over and over again in an amount that suffices several uses only. The only small bottles that are available are sampler bottles that cannot be refilled.

There are available gas lighters that can be refilled with butane; however, those lighters can be refilled only from a dedicated gas balloon and they do not contain liquid material.

There is a need for a relatively small bottle that can be carried in a handbag, a purse, a makeup kit, a briefcase, in a utility case or any other small case that is carried by the user to work or to a date.

SUMMARY OF THE INVENTION

It is an object of the present invention to provide a refill bottle that is adapted to be easily refilled by a liquid that is pressurized provided in a bottle having a spaying mechanism.

It is another object of the present invention to provide a refill bottle adapted to be refilled by a liquid such as perfume, aftershave and the like.

It is yet another object of the present invention to provide a refill bottle that has a vaporizer or a roll on mechanism to remove the liquid.

It is thus provided in accordance with the present invention, a refill bottle adapted to receive liquid comprising:

- a bottle having a bottom portion and an upper portion;
- an opening provided in said upper portion wherein said opening is adapted to be covered;
- a refill mechanism provided in said bottom portion;
- whereby the liquid is received through said refill mechanism from a regular bottle provided with a spraying mechanism and is withdrawn through said opening.

Furthermore, in accordance with another preferred embodiment of the present invention, said upper portion is provided with a spraying mechanism.

Furthermore, in accordance with another preferred embodiment of the present invention, said spraying mechanism comprises a tube adapted to be placed in the liquid and a pump communicating with said tube, wherein said pump is provided with a nozzle through which the liquid is adapted to be sprayed.

Furthermore, in accordance with another preferred embodiment of the present invention, said upper portion is provided with a spreading mechanism.

Furthermore, in accordance with another preferred embodiment of the present invention, said spreading mechanism is provided with a bounded and rotatable ball having a portion communicating with the liquid and a portion communicating with an outer portion of the refill bottle.

Furthermore, in accordance with another preferred embodiment of the present invention, said ball is a glass ball.

Furthermore, in accordance with another preferred embodiment of the present invention, said refill mechanism is provided with a check valve.

Furthermore, in accordance with another preferred embodiment of the present invention, said check valve is adapted to open when a stem is pushed through a bottom opening provided in said bottom portion and wherein the liquid is pushed inside the refill bottle through said stem.

Furthermore, in accordance with another preferred embodiment of the present invention, said stem is a conduit provided in a spraying mechanism of a regular spray bottle.

Furthermore, in accordance with another preferred embodiment of the present invention, said bottom opening is adapted to receive a conduit provided in a spraying mechanism of a regular spray bottle.

Additionally, in accordance with another preferred embodiment of the present invention, said liquid is selected from a group of liquids such as perfume or aftershave.

BRIEF DESCRIPTION OF THE FIGURES

In order to better understand the present invention and appreciate its practical applications, the following Figures are attached and references herein. Like components are denoted by like reference numerals.

It should be noted that the figures are given as examples and preferred embodiments only and in no Way limit the scope of the present invention as defined in the appending Description and Claims.

DETAILED DESCRIPTION OF THE INVENTION AND FIGURES

The present invention provides a unique and novel refill bottle adapted especially for liquids such as perfumes and aftershaves. There is no available efficient refill bottle for perfume or other alike materials that is adapted to be refilled from a regular bottle having a spraying mechanism. There is a long felt need to provide a refill bottle that the user can easily carry with him for a very short time, so the bottle is relatively small and can be carried in a purse or a handbag. This is in light of the fact that perfume bottles are relatively large and are highly expensive.

The refill bottle of the present invention can be provided with an opening that is covered with a conventional rotatable cover so as to take out the liquid or can be provided with a vaporizer adapted to allow spraying the liquid out. In another aspect of the present invention, the bottle can be provided with a roll on mechanism so as to remove the liquid.

The bottom portion of the bottle is provided with a refill mechanism that can be a check valve through which liquid can be inserted into the bottle in preferably a pressurized manner.

Figure 1A:
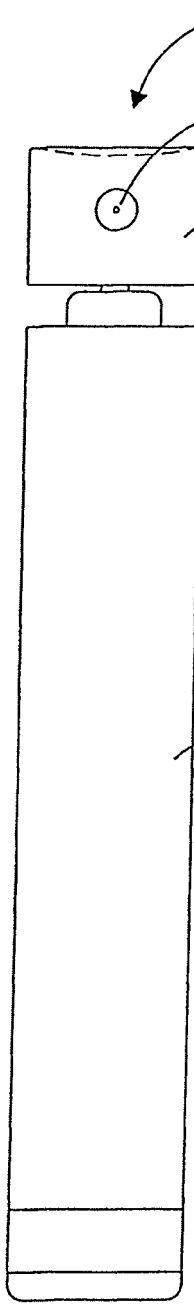
FIG. 1*a* illustrates an isometric view of a refill bottle in accordance with a preferred embodiment of the present invention, provided with a vaporizer mechanism.
Figure 1B:
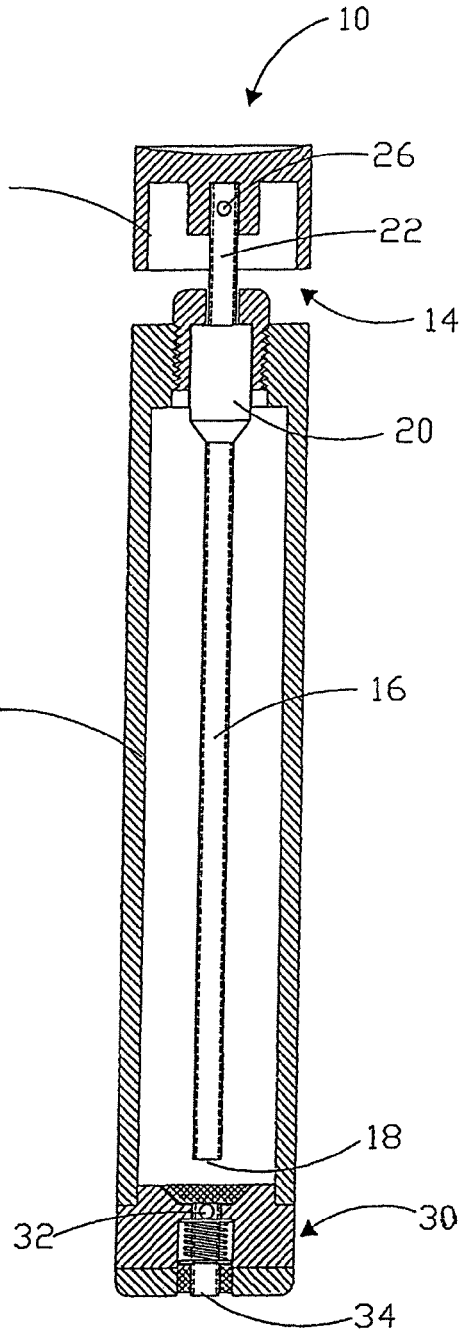
FIG. 1*b* illustrates a cross sectional view of the refill bottle shown in FIG. 1*a*.

Reference is now made to FIGS. 1*a* and 1*b* illustrating isometric and cross sectional views of a refill bottle in accordance with a preferred embodiment of the present invention, provided with a vaporizer mechanism. Refill bottle 10 is preferably a cylindrical bottle 12 made of glass that is provided with a vaporizing mechanism 14. The vaporizing mechanism 14 is based on a pump that is adapted to take out the liquid that is received in refill bottle 10 by spraying the liquid onto the user's body (the liquid is not shown in the figures). Vaporizing mechanism 14 comprises elongated tubing 16 that is placed in the bottle so that an opening 18 through which liquid is drawn through is placed in the bottom of the bottle or the liquid. Vaporizing mechanism 14 is further provided with a check valve 20 that is basically a one-way valve and a hollow valve stem 22 wherein check valve 20 is adapted to allow liquid to pass through hollow valve stem 22 upon the stem being forced downward to the check valve. Hollow valve stem 22 moves upward when the force is removed due to a small spring that is placed within check valve 20 (the spring is not shown in the Figure). A spray button 24 is provided on top of hollow valve stem 22 so as to allow the user to push the stem downward. When hollow valve stem 22 is pushed downward, the pressurized liquid passes through hollow stem 22 and is sprayed through an opening 26 in the stem. Opening 26 is in fluid communication with a nozzle 28 that is provided in spray button 24 through which the liquid is sprayed onto the user's body. Spraying pumps are basically known in the art.

The bottom portion of refill bottle 10 is provided with a refill mechanism 30. Refill mechanism is basically a check valve 32 allowing fluid to be inserted into the bottle without the ability to leak out through refill mechanism 30. Check valve 32 opens when a stem is inserted through bottom opening 34 and pushed to open the check valve.

Figure 1C:
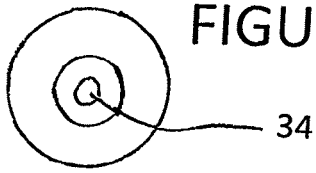
FIG. 1*c* illustrates a bottom view of the refill bottle shown in FIG. 1*a*.
Figure 2A:
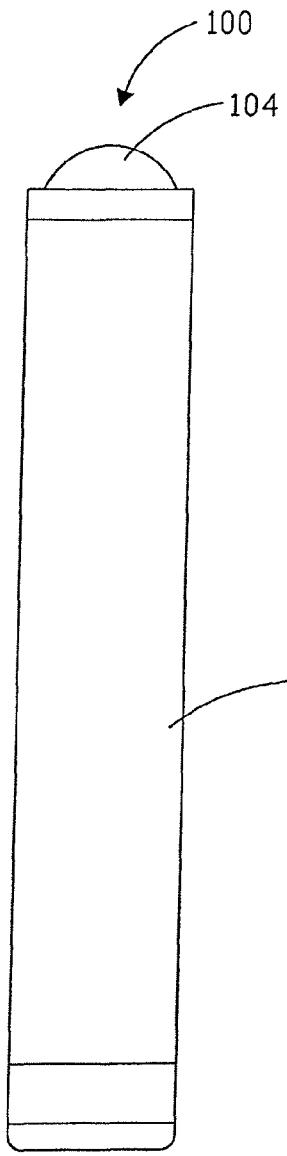
FIG. 2*a* illustrates an isometric view of a refill bottle in accordance with another preferred embodiment of the present invention.
Figure 2B:
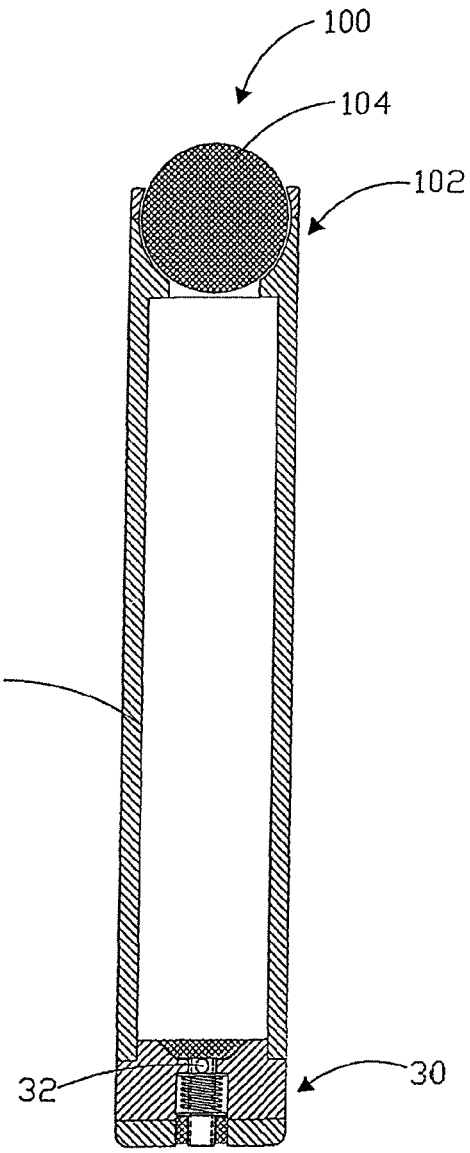
FIG. 2*b* illustrates an elevated view of the refill bottle shown in FIG. 2*a*.
Figure 2C:
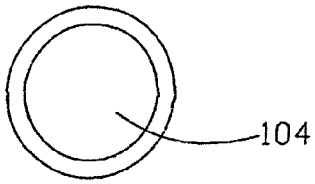
FIG. 2*c* illustrates a cross sectional view of the refill bottle shown in FIG. 2*a*.
Figure 2D:
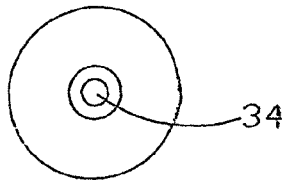
FIG. 2*d* illustrates a bottom view of the refill bottle shown in FIG. 2*a*.

Reference is now made to FIG. 1*c* illustrating a bottom view of the refill bottle shown FIG. 1*a*. Bottom opening 34 is adapted to receive a conduit through which liquid passes and pushed through the check valve in a pressurized manner.

Bottle 10 is refilled through refill mechanism 30 while the liquid is dispensed from the bottle through vaporizing mechanism 14. As mentioned herein before, the refill bottle of the present invention is adapted to be refilled with liquids such as perfume or aftershave that are withdrawn from regular bottles that are available in the industry. Most of the perfume and aftershave bottles are provided with a spraying mechanism similar to the one described herein before.

Figure 3:
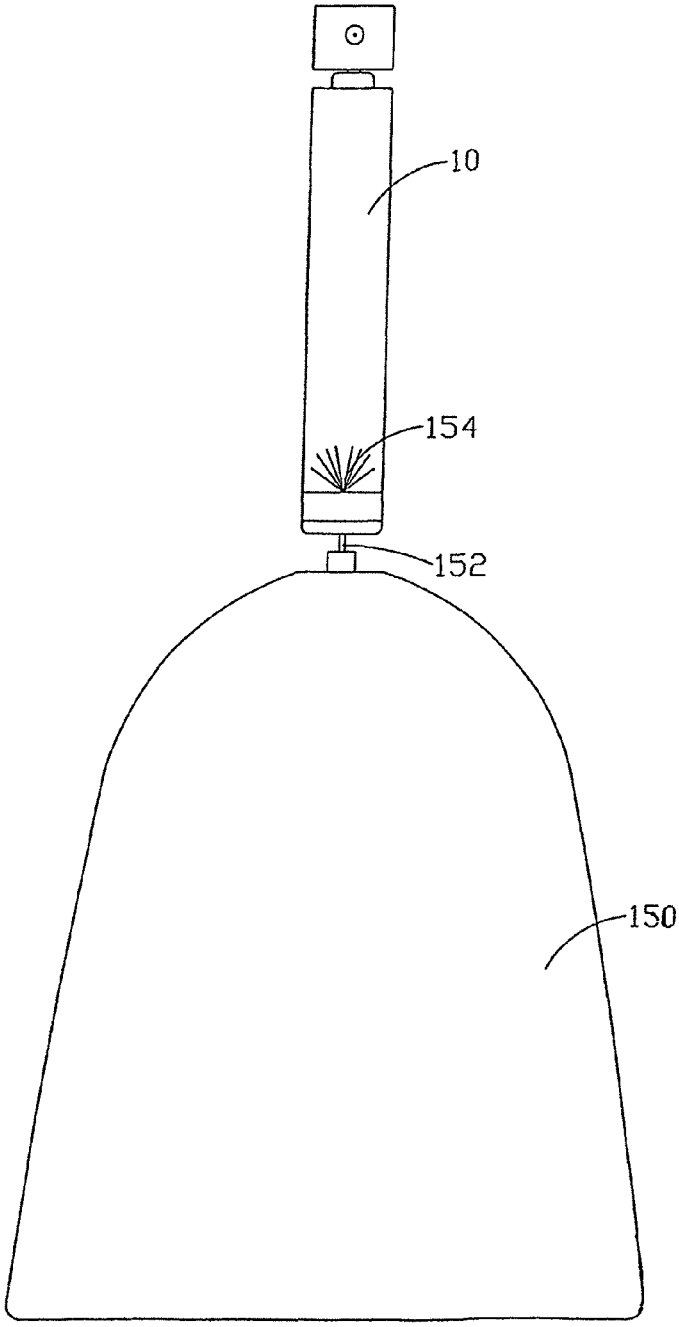
FIG. 3 illustrates a refill bottle in accordance with a preferred embodiment of the present invention, filled with liquid from a regular bottle.

Reference is now made to FIG. 3 illustrating a refill bottle in accordance with a preferred embodiment of the present invention, filled with liquid from a regular bottle. The spray button is removed from a regular perfume bottle 150 so that the stem 152 of the spraying mechanism is exposed. Stem 152 is pushed into the bottom opening of refill bottle 10 and is pushed upwardly towards the check calve so as to open it and push a portion of the liquid 154 into refill bottle 10. Refill bottle 10 is filled to the desired amount and perfume bottle 150 is removed. The refill bottle is designed to be very small so the user can fill in other perfume each time according to his needs.

Reference is now made to FIG. 2 *a-d* illustrating views of a refill bottle in accordance with another preferred embodiment of the present invention.

Refill bottle 100 is basically similar to refill bottle 10, however, refill bottle 100 is provided with another mechanism for spreading the liquid. The upper portion of refill bottle 100 is provided with a spreading mechanism 102 comprising preferably a glass ball 104 that is bounded in the upper portion of the bottle and is adapted to rotate within it boundary. A portion of glass ball 104 is in communication with the inner part of the bottle and a portion is in communication with the outer environment. When glass ball 104 is rotated on a body, it spreads the liquid. This mechanism is known especially in deodorant industry. The bottom portion of refill bottle 100 is provided with a refill mechanism 30 such as the one used in refill bottle 10.

The refill bottle of the present invention is a small bottle that can receive a small amount of liquid that is adapted for several uses. The user can therefore fill in other perfume or aftershave every time he goes out of the house while carrying the refill bottle in his purse or handbag.

It should be clear that the description of the embodiments and attached Figures set forth in this specification serves only for a better understanding of the invention, without limiting its scope as covered by the following Claims.

It should also be clear that a person skilled in the art, after reading the present specification can make adjustments or amendments to the attached Figures and above described embodiments that would still be covered by the following Claims.

The invention claimed is:

1. A method of refilling a perfume dispenser with a non-compressible liquid from a perfume bottle having a spraying mechanism that comprises a stem through which the non-compressible liquid is dispensed and a removable spray button, the method comprising:

providing a perfume dispenser having an atomizer in an upper portion of the perfume dispenser for dispensing non-compressible liquid and a refill mechanism in a bottom portion of the perfume dispenser, wherein said refill mechanism comprises a one-way check valve adapted to receive the stem of the perfume bottle;

removing the spray button from the spraying mechanism of the perfume bottle to expose the stem; and pushing the stem of the perfume bottle into the check valve to allow the non-compressible liquid to flow through said check valve into the perfume dispenser.

2. The method of refilling a liquid perfume dispenser as claimed in claim 1, wherein said atomizer comprises a tube positioned within the perfume dispenser, a pump communicating with said tube, and a nozzle communicating with the pump, through which nozzle the non-compressible liquid is sprayed in an outward direction.

3. A system comprising a refill perfume dispenser and a perfume bottle, said perfume bottle having a spraying mechanism comprising a stem capable of being exposed, said refill perfume dispenser being capable of receiving a liquid from said perfume bottle, said refill perfume dispenser comprising:

a bottom portion having a bottom opening;

an upper portion having an upper opening comprising a spraying mechanism; and a refill mechanism provided in said bottom portion, wherein said refill mechanism comprises a check valve that opens when said stem, after being exposed, is inserted through said bottom opening and pushed to open said check valve, wherein the liquid is pushed inside said refill perfume dispenser through said stem; and wherein the perfume is received through said refill mechanism from said perfume bottle and is dispensed through said spraying mechanism.

4. The system as claimed in claim 3, wherein said spraying mechanism comprises a tube adapted to be placed in the liquid and a pump communicating with said tube, wherein said pump is provided with a nozzle adapted to spray the liquid.

5. The system as claimed in claim 3, wherein said stem is a conduit provided in said spraying mechanism of said perfume bottle.

6. The system as claimed in claim 3, wherein said bottom opening is adapted to receive a conduit provided in said spraying mechanism of said perfume bottle.

7. The system as claimed in claim 3, wherein said liquid is a perfume or an aftershave.

8. A system comprising a perfume bottle and a refill perfume dispenser adapted to receive liquid from the perfume bottle, the system comprising:

a perfume bottle having a spraying mechanism with a stem and a spray cap covering the stem that can be removed to expose the stem; and a refill perfume dispenser comprising:

a bottom portion having a bottom opening having a refill mechanism; and an upper portion having an upper opening comprising a spraying mechanism, wherein said refill mechanism comprises a check valve that opens when said stem, after being exposed, is inserted through said bottom opening and pushed to open said check valve, wherein the liquid is pushed inside said refill perfume dispenser through said stem; and wherein the liquid is received through said refill mechanism from said perfume bottle and is dispensed through said spraying mechanism.

* * * * *